United States Patent [19]

Cameron

[11] Patent Number: 4,702,021

[45] Date of Patent: Oct. 27, 1987

[54] SHOE TRACTION APPARATUS

[76] Inventor: Emmet H. Cameron, 1950 Yale Ave., Salt Lake City, Utah 84108

[21] Appl. No.: 916,147

[22] Filed: Oct. 7, 1986

[51] Int. Cl.[4] ..... A43C 15/02; A43C 15/06

[52] U.S. Cl. ..... 36/62; 36/59 R

[58] Field of Search ..... 36/62, 61, 66, 59 R, 36/132, 136, 114, 71.5; 2/DIG. 6

[56] References Cited

U.S. PATENT DOCUMENTS

| | | | |
|---|---|---|---|
| 44,961 | 11/1864 | Landfear | 36/62 |
| 1,433,660 | 10/1922 | Shimko | 36/61 |
| 1,796,399 | 3/1931 | Roodhouse | 36/59 R |
| 2,075,229 | 3/1937 | Rose | 36/62 |
| 2,166,958 | 7/1939 | Lawson | 36/62 |
| 2,366,649 | 1/1945 | Priess | 36/62 |
| 2,425,939 | 8/1947 | Howard | 36/62 |
| 2,431,748 | 12/1947 | GershaK | 36/62 |
| 2,579,143 | 12/1951 | Fisher | 36/62 |
| 2,732,065 | 1/1956 | Marchese | 36/59 R |
| 3,258,863 | 7/1966 | Paget | 36/62 |
| 3,573,155 | 3/1971 | Mitchell | 36/59 R |
| 4,286,396 | 9/1981 | Deacon | 36/62 |

FOREIGN PATENT DOCUMENTS

| | | | |
|---|---|---|---|
| 1561243 | 2/1969 | Italy | 36/59 R |
| 2061201 | 5/1981 | United Kingdom | 36/59 R |

OTHER PUBLICATIONS

"Self Adhering Nylon Tapes", Journal of the AMA, vol. 168, No. 7, 10/19/58, Gershman.

*Primary Examiner*—Henry S. Jaudon
*Assistant Examiner*—Steven N. Meyers
*Attorney, Agent, or Firm*—Henderson & Sturm

[57] ABSTRACT

An improved shoe traction apparatus (10) comprising an elongated strap member (15) provided with releasable engaging means (12) on the ends, an upper frictional unit (13) and a lower composite frictional unit (14) formed intermediate the ends; whereby the upper frictional unit (13) engages the sole (51) of the users shoe (50); and, the lower composite frictional unit (14) engages a slippery surface (100); and, wherein the lower composite frictional unit (14) comprises a relatively hard frictional component (19) and a relatively soft frictional component (20).

1 Claim, 6 Drawing Figures

FIG. 1.
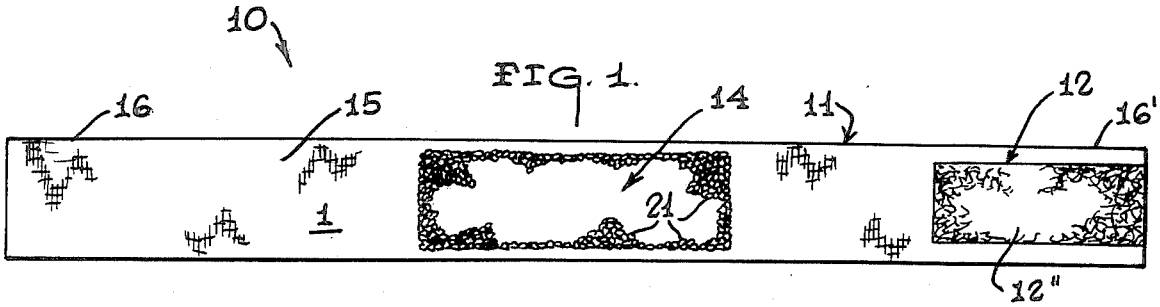
FIG. 2.
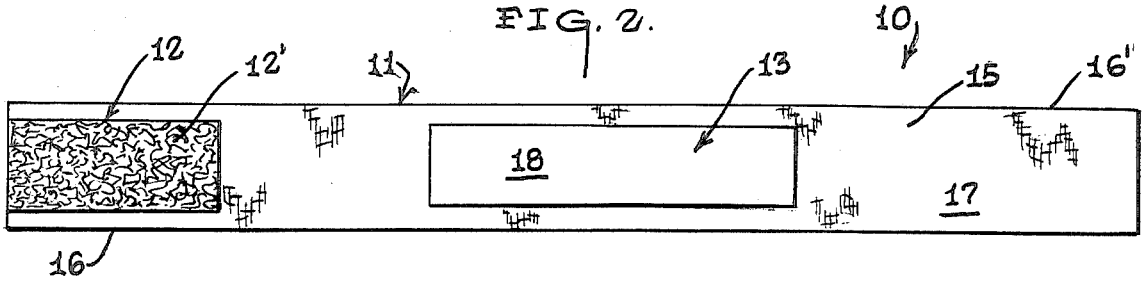
FIG. 3.
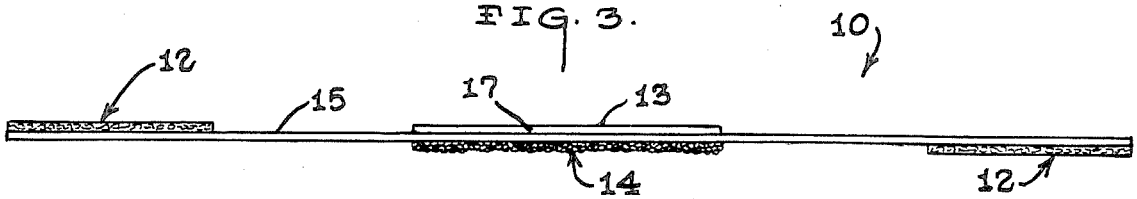
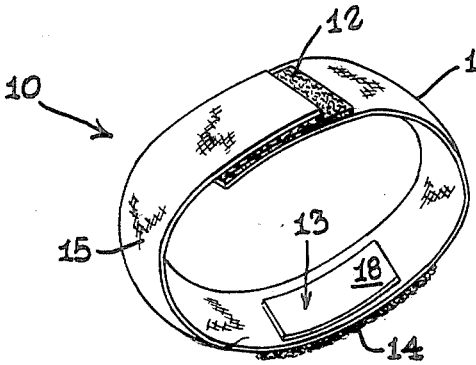
FIG. 4.
FIG. 5.
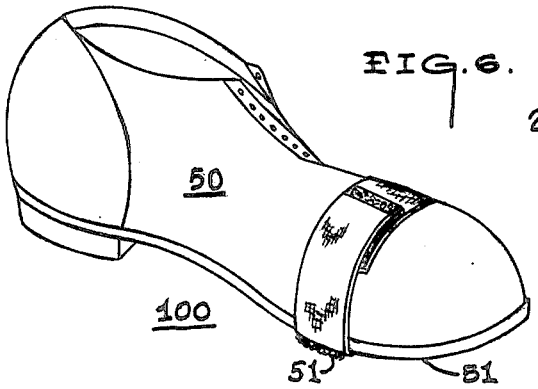
FIG. 6.
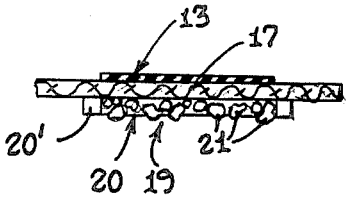

SHOE TRACTION APPARATUS

TECHNICAL FIELD

The present invention relates generally to add-on footwear traction devices.

BACKGROUND OF THE INVENTION

The prior art is replete with add-on devices which are intended to improve traction for the user on slippery surfaces as may be seen by reference to the following U.S. Pat. No's: 2,366,649; 2,425,939; 3,258,863; and, 4,286,396.

While these prior art devices provide effective traction for their given environment; they are totally unsuitable for use beyond restrictive environments for which they were specifically developed.

The majority of prior art structures were developed to improve the users traction while walking on ice; and, these constructions generally utilize metallic spikes for penetrating engagement with the ice. An attempt to walk from an icy surface to a different type of hard and/or slippery surface such as tiled or waxed floors while wearing these devices would produce less effective traction plus discomfort for the user. In addition, these spikes in an attempt to penetrate the surface would scratch and otherwise mar or damage the surface in question. Furthermore, an attempt to walk wearing these devices onto a penetrable or soft surface such as a rug would also result in damage to the surface in question. The penetrating spikes would snag on rug fibers producing noticeable tears and rips in this surface.

While the majority of prior art traction devices utilize rigid spike elements, other prior art constructions only employ high friction material such as rubber or the like to provide sure footing for the user. There is even at least one instance, wherein a porous fabric or cloth is relied upon to supply traction for the user.

The aforementioned cloth grip, while specifically designed and imminently suitable for the bath/shower environment, is rendered virtually useless and impractical when employed in an outdoor environment. In addition, it would also appear that the cloth version would experience diminished frictional resistance to carry out its intended purpose, once the cloth becomes saturated with water and soap as would normally be encountered in a bath or shower.

Obviously there existed a need for an improved traction device which would be adaptable to both icy surfaces, as well as such diverse indoor surfaces as carpet or tile, which are susceptable to scratching and tearing to various degrees. This improved device would also have to provide adequate frictional resistance for all of these myriad surfaces without requiring the user to continually remove and re-engage the traction device as different footing conditions were encountered.

SUMMARY OF THE INVENTION

The improved footwear traction device of this invention was specifically developed to provide all around traction for walking on ice, snow and other slippery surfaces, as well as, normal indoor surfaces. In addition, this device was designed to be attached or detached easily and quickly to or from the users person and to occupy a minimal amount of space when not in use.

In general the improved shoe traction apparatus of this invention comprises a shoe encircling unit provided with releasable engaging means; wherein the intermediate portion of the shoe encircling unit is provided an upper frictional unit to enhance the frictional engagement of the apparatus with the sole of the users footwear; and, a composite lower frictional unit comprising relatively soft and relatively hard frictional components.

The relatively hard and relatively soft frictional components are formed in such a way that a portion of the relatively hard frictional components initially projects beyond the relatively soft frictional components; whereupon the gradual degradation of the exposed relatively hard frictional component will bring an increasing surface area of the relatively friction component into contact with the surface that is being traversed by the user.

In addition, as the relatively soft frictional component experiences gradual degradation, new and additional portions of the relatively hard frictional component will be brought into contact with the slippery surface, so that the apparatus will provide effective traction for the user on slippery surfaces until such time as the composite lower frictional unit is completely worn down.

BRIEF DESCRIPTION OF THE DRAWINGS

These and other objects, advantages, and novel features of the invention will become apparent from the detailed description of the best mode for carrying out the preferred embodiment of this invention which follows; particularly when considered in conjunction with the accompanying drawings, wherein:

FIG. 1 is a bottom plan view of the traction apparatus;

FIG. 2 is a top plan view of the apparatus;

FIG. 3 is a side elevation view of the apparatus;

FIG. 4 is an isolated perspective view of the apparatus in its operative mode;

FIG. 5 is a perspective view of the apparatus deployed on footwear; and,

FIG. 6 is an enlarged cross-sectional view of the friction surfaces of the apparatus.

BEST MODE FOR CARRYING OUT THE INVENTION

As can be seen by reference to FIGS. 1 thru 3, the improved shoe traction apparatus that forms the basis of the present invention is designated generally by the reference numeral (10). The apparatus (10) comprises in general a shoe encircling unit (11) provided with releasable engaging means (12) wherein the shoe engaging unit (11) is further provided with an upper frictional unit (13); and, a lower composite frictional unit (14). These units will now be described in seriatim fashion.

As best shown in FIGS. 1 and 2, the shoe encircling unit (11) comprises an elongated strap member (15) provided with releasable engaging means (12) disposed on opposite sides of each end (16)(16') of the strap member (15).

In the preferred embodiment of this invention the elongated strap member (15) would be fabricated from an elongated strip of resilient material (17), such as an elasticized fabric or the like; wherein the elongated strap member (15) would be capable of expansion and contraction, so as to conform to the flexure of the users footwear.

In the embodiment depicted in FIGS. 1 thru 5, the releasable engaging means (12) comprises complementary hook (12') and loop (12") fastening members, such as VELCRO TM fasteners, or the like, which are disposed on opposite sides of each end (16)(16') of the strap member (15).

As shown in FIGS. 1 thru 3, the intermediate portion of the strap member (15) is provided with an upper frictional unit (13) and a lower composite frictional unit (14). The upper frictional unit (13) is designed to enhance the frictional engagement of the apparatus (10) with the sole (51) of a users shoe (50), or the like; while the lower composite frictional unit (14) is designed to produce enhanced frictional engagement of the apparatus (10) with a slippery surface (100).

As can best be seen by reference to FIG. 6, the upper frictional unit (13) comprises a relatively thin layer (17) of high friction material (18) such as rubber or the like; wherein the material (18) is impregnated or otherwise affixed to the top of the elongated strap member (15).

As can also be seen by reference to FIG. 6, the lower composite frictional unit (14) comprises a relatively hard frictional component (19) and a relatively soft frictionial component (20) disposed on the bottom of the strap member (15). For the purposes of the remainder of this specification the term relatively hard will be understood to equate to the ability of the material to withstand deformation; whereas, the term relatively soft will equate to the ability of the material to be susceptible to deformation.

Still referring to FIG. 6, it can be seen that the relatively hard frictional component (19) comprises a particulate aggragate or grit made up of a plurality of discrete particles (21) that are both partially and wholly embedded in the relatively soft frictional component (20). In the preferred embodiment of this invention the relatively hard frictional component (19) comprises particles (21) of rock or the like; and, in an alternate embodiment of this invention the relatively hard frictional component (19) comprises seed particles (21).

In the first instance, the rock particles are intended to provide an extended useful life for the apparatus; and, in the later instance the seed particles (21) will provide a very brief useful life for the user; but, will also function to provide scattered edible foodstuffs for birds, during those periods when most birdseed is covered by the icy surfaces for which this apparatus (10) was specifically developed.

As shown in FIG. 6, the relatively soft frictional component (20) comprises a relatively thick coating (20') of frictional material such as silicone rubber or the like, which captively surrounds the individual particles (21) in either a wholly or partially enveloped relationship.

As can be seen by reference to FIGS. 4 and 5, the releasable engaging means (12) are intended to form the strap member (15) into an encircling loop around the users shoe (50), wherein the upper frictional unit (13) engages the sole (51) of the users shoe; and the lower composite frictional unit (14) engages a slippery surface (100).

As mentioned previously, the lower composite frictional unit (14) was specifically developed so that the relatively hard frictional component (19) will at least initially make contact with the slippery surface (100). Thereafter, as the hard particles (21) wear down or are otherwise disengaged from the composite frictional unit (14), an increasing surface area of the relatively soft frictional component (20) will be brought into contact with the slippery surface (100); and, continued degradation of the relatively soft frictional component (20) will expose previously covered particles (21).

Having thereby described the subject matter of this invention, it should be obvious that many substitutions, modifications and variations of the invention are possible in light of the above teachings. It is therefore to be understood that the invention as taught and described herein is only to be limited to the extent of the breadth and scope of the appended claims.

I claim:

1. A shoe traction apparatus consisting of:

an elongated strap member provided with releasable engaging means on opposite ends;

an upper frictional unit formed on the top of the strap member intermediate the ends; and, a lower composite frictional unit formed on the bottom of the strap member intermediate the ends; wherein, the composite frictional unit comprises a relatively hard frictional component and a relatively soft frictional component; wherein, the relatively soft frictional component partially and wholly surrounds different portions of the relatively hard frictional component, and, wherein, the relatively hard frictional component comprises a plurality of discrete edible seed particles; whereby individual edible seed particles will become disengaged from the relatively soft frictional component at intervals during use to provide a food source for birds.

* * * * *